United States Patent [19]

Matsui

[11] 4,147,279

[45] Apr. 3, 1979

[54] FOLDINGLY COLLAPSIBLE CONTAINER AND HOLDER-STAND THEREFOR

[76] Inventor: Ichinosuke Matsui, No. 3-226-2, Nisshin, Oomiya-shi, Saitama-ken, Japan

[21] Appl. No.: 879,385

[22] Filed: Feb. 21, 1978

[30] Foreign Application Priority Data

Nov. 2, 1977 [JP] Japan ..... 52/131874

[51] Int. Cl.[2] ..... B65D 83/00

[52] U.S. Cl. ..... 222/95; 150/0.5

[58] Field of Search ..... 150/0.5; 229/95, 104, 229/107; 229/41 R

[56] References Cited

U.S. PATENT DOCUMENTS

| | | | |
|---|---|---|---|
| 399,376 | 3/1889 | Capehart | 150/44 |
| 2,318,928 | 5/1943 | Deighton | 222/95 |
| 3,083,877 | 4/1963 | Gash | 222/107 |
| 3,319,684 | 5/1967 | Calhoun | 229/41 R X |
| 3,354,924 | 11/1967 | Birrell | 150/0.5 |
| 3,907,193 | 9/1975 | Heller | 150/0.5 X |

*Primary Examiner*—Donald F. Norton

*Attorney, Agent, or Firm*—Oblon, Fisher, Spivak, McClelland & Maier

[57] ABSTRACT

A collapsible container having rigid bottom and top walls of equilateral polygonal shape, quadrilateral side walls laterally endlessly connected with each other and joined with the opposing sides of the top and bottom walls, and a dispensing mouth provided at the center of the top wall. The side walls are foldable along outwardly creased ridges which demarcate them from each other and from the top and bottom walls and along diagonal inward creases running from one top corner to the non-adjacent bottom corner of the respective side walls. A holder-stand for the container is also provided within which the container can be disposed for dispensing material.

6 Claims, 8 Drawing Figures

FOLDINGLY COLLAPSIBLE CONTAINER AND HOLDER-STAND THEREFOR

BACKGROUND OF THE INVENTION

1. Field of the Invention

This invention relates to a collapsible or foldable container for toothpastes, cosmetics, adhesives, relishes, etc., and more particularly to a collapsible container which is constructed to stand in an upright position by itself and which is particularly suitable for pasty creamy or other consistent materials.

2. Description of the Prior Art

Goods of pasty, creamy or other consistent materials are generally packaged in soft slender metal tubes which have a flatly sealed bottom at an end opposite the dispensing end. With a tube container of this sort, it is the usual experience that, when the tube is squeezed in the middle, the content material in the squeezed portion spreads apart toward the bottom and dispensing ends without being effectively extruded through a mouth at the dispensing end. In addition, one has to use both hands in removing and replacing its cap and squeezing out its content since the tube cannot stand stably in an upright position by itself.

The present invention contemplates to providing a novel collapsible or foldable container which can assume an upright position stably by itself and which is collapsible upon applying thereon a vertical force with a finger or fingers to dispense the content material in an amount commensurate with the magnitude of the applied force.

SUMMARY OF THE INVENTION

It is an object of the present invention to provide a collapsible container which has flat bottom and top walls and a number of side walls which are foldable inwardly as the content of the container is dispensed, constraining the content material towards a dispensing mouth at the center of the top wall.

It is another object of the invention to provide a collapsible container which can stand stably in upright position by itself.

It is still another object of the present invention to provide a collapsible container of the nature mentioned above, which is simple in construction and easy to manufacture.

According to the present invention, there is provided a collapsible container comprising: a bottom wall of an equilateral polygonal shape; a top wall of the same shape as the bottom wall and centrally provided with a dispensing mouth; and quadrilateral side walls provided in a number corresponding to the number of sides of the polygonal bottom wall, the side walls being laterally endlessly connected with each other and joined with the opposing sides of the bottom and top walls, the side walls being demarcated by an outwardly creased ridge on the marginal edges bordering on the adjacent side walls and the top and bottom walls and each having a diagonal inward crease running from one top corner to a non-adjacent bottom corner thereof.

In one preferred form of the invention, the respective walls of the container are formed of stiff material and a flexing groove is provided along the ridges which demarcate the side walls from each other and from the adjacent bottom and top walls.

If desired, the collapsible container may be used in combination with a holder-stand as will be described hereinafter.

The above and other objects, features and advantages of the invention will become apparent from the following description and the appended claims, taken in conjunction with the accompanying drawings which show by way of example preferred embodiments of the invention.

DETAILED DESCRIPTION OF THE PREFERRED EMBODIMENTS

Figure 1:
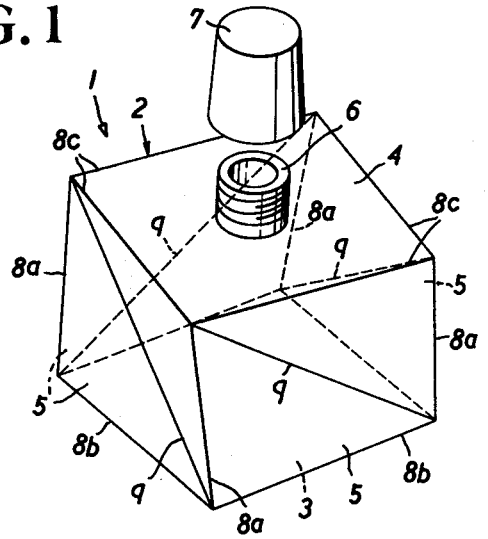
FIG. 1 is a diagrammatic perspective view of a foldable container embodying the present invention.

Referring to the accompanying drawings and first to FIG. 1, there is shown one preferred form of the foldable container according to the invention, wherein the container is generally indicated by reference numeral 1 and has a substantially rectangular box-like shape. The foldable container 1 has square bottom and top walls 3 and 4, and rectangular side walls 5 laterally endlessly connected to each other and joined to the opposing sides of the bottom and top walls 4 and 5. The respective walls of the container 1 are formed normally from a water-proof paper sheet, a synthetic resin sheet or other sheet material which has suitable stiffness or which is not easily deformable. The top wall 3 is centrally provided with an opening to receive a mouthpiece 6 which is, in this particular embodiment, externally threaded for engagement with internal threads of a cap 7. The mouthpiece 6 and cap 7 may be detachably engaged with each other by different modes of engagement and may be provided in different shapes. The ridges 8*a*, 8*b* and 8*c* between the respective walls of the container 1 are creased such that the adjacently connected walls are foldable therealong toward each other. The side walls 5 are provided with diagonal inward creases 9 all in the same direction.

Figure 2:
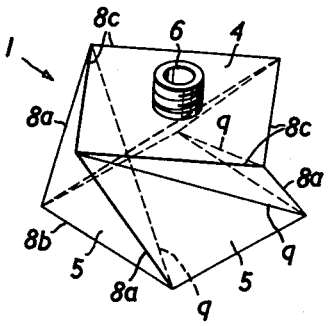
FIGS. 2 and 3 are diagrammatic perspective views showing the same container in half-folded and substantially completely folded states, respectively.
Figure 3:
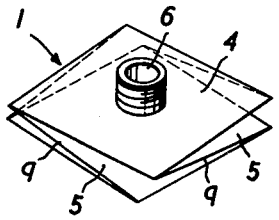
Figure 4:
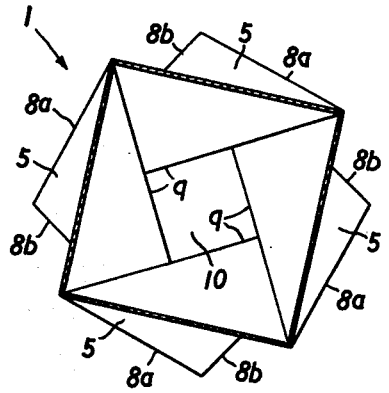
FIG. 4 is a plan view of the half-folded container with its top wall cut away to show the manner in which the folded side walls lie one on the other.

With the container of the construction described above, a pressure applied vertically on the container 1 causes the side walls 5 to be folded inwardly along the respective diagonal creases 9 and at the same time along the ridges 8*a*, 8*b* and 8*c*, folding or collapsing the container 1 in a twisted form as shown in FIG. 2. As the container 1 is further pressed, the container body is collapsed to have a more reduced volume and finally becomes almost flat as shown in FIG. 3.

As the container 1 is collapsed, the inside angles $\theta_a$ and $\theta_b$ of the ridges 8*a*, 8*b* and 8*c* (FIG. 5) become smaller and the walls meeting at those ridges get closer to each other, so that the pasty content material is pushed toward the center of the container 1 by the squeezing action of the collapsing walls, gathering in a central hollow space 10. Simultaneously, the central hollow space 10 is constricted by the inwardly projecting folds which are formed along the creases 9 of the side walls 5, and superimposed one on another in the fashion of shutter blades. As a result, the pasty or creamy content is squeezed out through the mouthpiece 6 until the container 1 is completely emptied.

Figure 6:
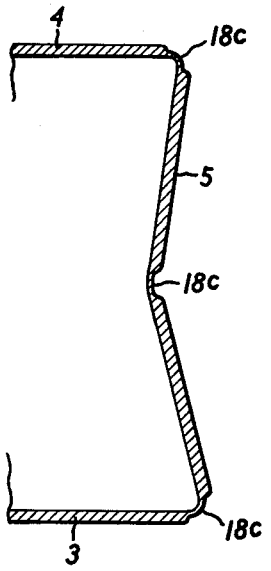
FIG. 6 is a fragmentary sectional view of a container having flexing grooves along the ridges which demarcate the respective side walls from each other and from the bottom and top walls.

In order to facilitate the collaption of the side walls 5, there may be provided a flexing groove 18*c* of suitable width along the ridges 8*a* to 8*c* and the diagonal creases 9 as shown in FIG. 6. With this arrangement, the walls of the container 1 has increased flexibility along the grooves 18*c* and the side walls 5 more easily yield into the respective folding directions upon application of a vertical pressure with a finger or fingers.

Figure 5:
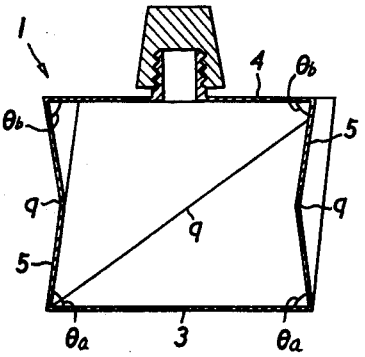
FIG. 5 is a vertical cross section of a foldable container of preferred shape.

The container has suitable foldability especially in a case where its side walls are parallelogramic shaped with the respective longer sides connected to the opposing sides of the top and bottom walls and/or where they are prebiased or prepossessed with a hollow angular indentation along the diagonal creases 9. In the latter case, a fully charged container has side walls which are angularly and diagonally indented at a slight degree as shown in FIG. 5.

Figure 7:
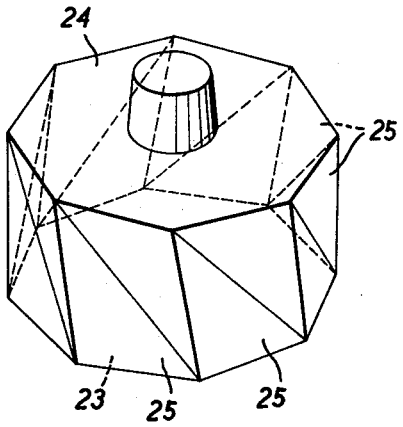
FIG. 7 is a diagrammatic perspective view of a container having octagonal bottom and top walls.

The top and bottom walls are not limited to the square shape and may be formed in other equilateral polygonal shape, for example, in an octagon as shown in FIG. 7. The respective side walls of the octagonal container are folded or collapsed through the same mechanism as in the case of the rectangular container 1 described hereinabove.

Figure 8:
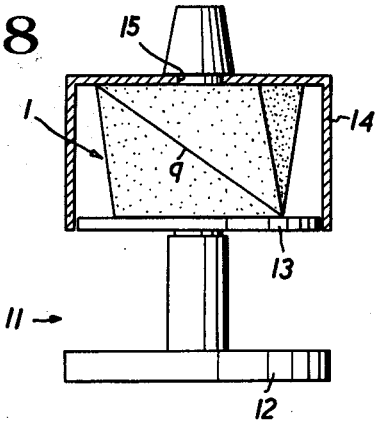
FIG. 8 is a partially sectioned front view of a holder-stand to be used with the foldable container.

FIG. 8 illustrates a holder-stand for the foldable container according to the invention. The holder-stand consists of a stand having a round top plate 13 swivelled on a vertical leg of a base 12 and a cylindrical holder cover 14 preferably formed of a hard rigid material and having an inside diameter larger than the top plate 13. The holder cover is open at the lower end and provided with an opening 15 at the center of the closed top wall for receiving the mouthpiece 6 of the container. The cylindrical side wall of the holder cover has a height greater than that of the side walls of the container to be placed on the top plate, so that, when the holder cover 14 is fitted on the container on the top plate 13, the lower marginal portions of the cylindrical side walls loosely circumvent the top plate 13.

In order to extrude the pasty or other consistent material from the container in the holder-stand, after removing the cap, a pressure is applied with a finger on the top wall of the cover holder, whereupon the side walls of the container are twistingly folded in the above-described manner and the material is squeezed out from the mouthpiece 6. In this instance, the twisting motion of the container is completely absorbed by the rotation of the top plate 13.

The height of the above described foldable container is limited due to its particular folding mechanism. Where it is desired to obtain a tall or slender collapsible container, each side wall may be divided by horizontal outward creases into two or three or more wall sections having diagonal inward creases of the same direction. In such a case, the subdivided wall sections on a different level may have the diagonal inward creases of the other direction.

Obviously, many modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A collapsible container comprising:

a bottom wall of an equilateral polygonal shape;

a top wall of the same shape as said bottom wall and centrally provided with a dispensing mouth; and quadrilateral side walls provided in a number corresponding to the number of sides of said polygonal bottom wall;

said side walls being laterally endlessly connected with each other and joined with the opposing sides of said bottom and top walls and said side walls being demarcated from each other and from said bottom and top walls by outwardly creased ridges and each having a diagonal inward crease running from one top corner to a non-adjacent bottom corner thereof wherein said container is set on a holder-stand comprising a round rotatable top plate and a bottomless cylindrical cover having an opening at the center of the top wall thereof for receiving said dispensing mouth of said container, said cover being fitted over the body of said container and loosely around the circumference of said top plate.

2. A collapsible container as defined in claim 1, wherein the respective walls of said container are formed of rigid material and a flexing groove is provided along said outwardly creased ridges which demarcate said side walls from each other and from the adjacent bottom and top walls.

3. A collapsible container as defined in claim 2, wherein said bottom and top walls are formed in square shape.

4. A collapsible container as defined in claim 2, wherein said side walls are each prepossessed with a shallow angular indentation along said diagonal inward crease.

5. A holder-stand for a collapsible container comprising a round rotatable top plate and a bottomless cylindrical cover having an opening at the center of the top wall thereof for receiving said dispensing mouth of said container, said cover being fitted over the body of said container and loosely around the circumference of said top plate.

6. A holder-stand as defined in claim 5, which further comprises a base plate wherein said round rotatable top plate is swivelably connected to said base plate.

* * * * *